US005415348A

United States Patent [19]

Nelson

[11] Patent Number: 5,415,348

[45] Date of Patent: May 16, 1995

[54] QUICK CHANGE AND EASILY IDENTIFIABLE NOZZLE CONSTRUCTION FOR USE IN MODULAR SPRINKLER ASSEMBLY

[75] Inventor: Craig B. Nelson, Walla Walla, Wash.

[73] Assignee: Nelson Irrigation Corporation, Walla Walla, Wash.

[21] Appl. No.: 113,688

[22] Filed: Aug. 31, 1993

[51] Int. Cl.[6] ..... B05B 1/26; B05B 3/00

[52] U.S. Cl. ..... 239/71; 239/222.11; 239/222.17; 239/391; 239/600; 239/DIG. 1

[58] Field of Search ..... 239/600, 390, 391, 71, 239/73, 74, DIG. 1, 222.11, 222.17, 251, 252

[56] References Cited

U.S. PATENT DOCUMENTS

| | | | |
|---|---|---|---|
| 2,915,926 | 12/1959 | Woerner | 239/71 X |
| 3,779,462 | 12/1973 | Bruninga | 239/DIG. 1 X |
| 4,185,781 | 1/1980 | O'Brien | 239/600 |
| 4,538,763 | 9/1985 | Perry et al. | 239/600 |
| 4,570,858 | 2/1986 | Bintner et al. | 239/71 X |
| 4,718,607 | 1/1988 | Levine | 239/600 X |
| 4,738,401 | 4/1988 | Filicicchia | 239/600 |
| 5,190,224 | 3/1993 | Hamilton | 239/600 |
| 5,224,653 | 7/1993 | Nelson et al. | 239/222.17 |
| 5,253,807 | 10/1993 | Newbegin | 239/74 X |

FOREIGN PATENT DOCUMENTS

| | | | |
|---|---|---|---|
| 117023 | of 0000 | European Pat. Off. | 239/71 |

*Primary Examiner*—Andres Kashnikow
*Assistant Examiner*—Lesley D. Morris
*Attorney, Agent, or Firm*—Nixon & Vanderhye

[57] ABSTRACT

A sprinkler comprises a body having an inlet end, an outlet end and a support structure extending beyond the outlet end. A tubular adapter is removably secured to the inlet end of the body, and a quick change nozzle is slidably interposed between the adapter and the body, such that part of the nozzle is received within the adapter and another part the nozzle including a discharge orifice which is received within the body and extends to the outlet end, wherein the nozzle is held in place by the adapter. A cap assembly is removably secured to the support structure, the cap assembly mounting a rotatable stream distributor plate in axial alignment with the discharge orifice.

17 Claims, 4 Drawing Sheets

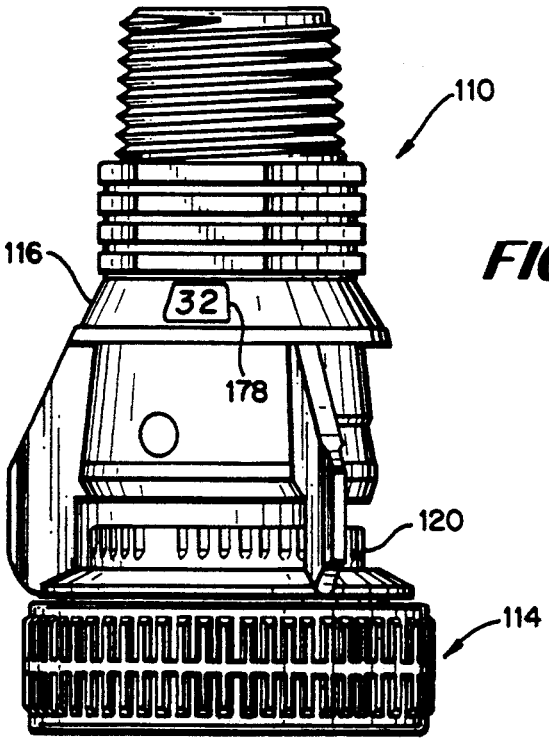
FIG. 9
FIG. 10
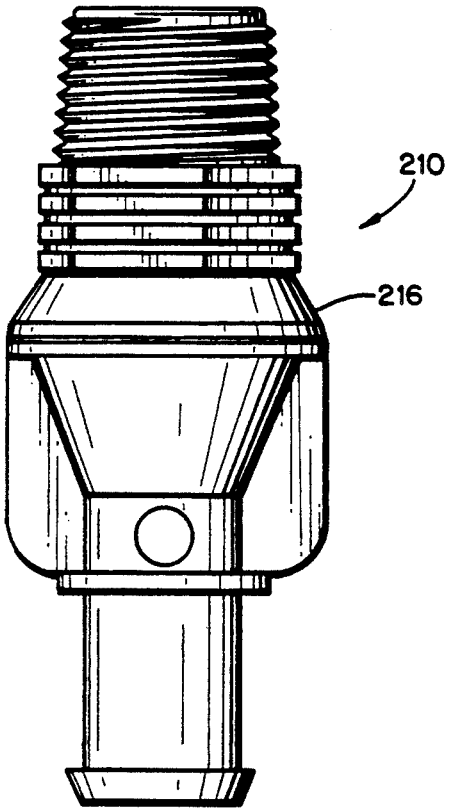
FIG. 4
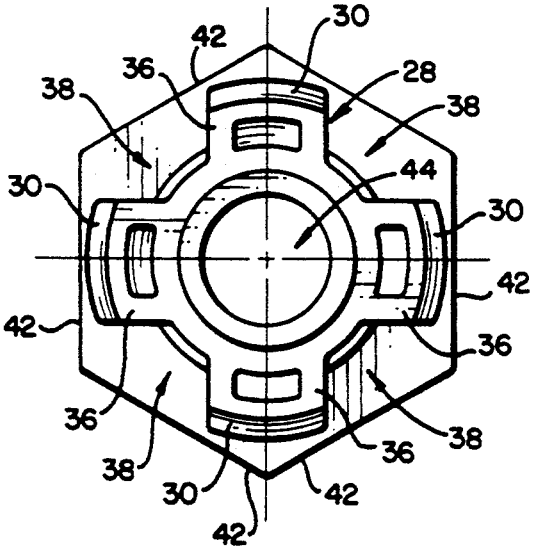

QUICK CHANGE AND EASILY IDENTIFIABLE NOZZLE CONSTRUCTION FOR USE IN MODULAR SPRINKLER ASSEMBLY

BACKGROUND AND SUMMARY OF THE INVENTION

This invention relates to sprinkler devices of the type utilized in connection with conventional pivot move and lateral move irrigation systems and, more specifically, to an improved modular sprinkler which incorporates a quick change, easily identifiable nozzle construction.

Moving irrigation systems, such as conventional pivot move and lateral move systems, typically incorporate conduit truss span assemblies which mount sprinkler heads, spaced along the truss assemblies for sprinkling or irrigating relatively large areas of land. The sprinkling heads may be mounted on top of the truss assemblies in a normal upright position, or they may be inverted and suspended from the span assembly by means of drop tubes. Another alternative is to utilize a hose drag type sprinkler, suspended from the truss assembly, and dragged on the ground through and between, for example, rows of crops.

Because of the large number of sprinkling heads utilized in a conventional pivot move or lateral move agricultural irrigation system, and because of the remote locations of such systems, it is important to be able to replace, and/or repair the sprinkler heads simply, quickly and efficiently.

The assignee of this invention currently manufactures modular spray heads which include a sprinkler body and a stream distributor (for example, a rotor plate or a fixed spray plate) which is designed for quick assembly and disassembly from the sprinkler body. The stream distributor is removably mounted within a cap assembly which, in turn, is secured to the sprinkler body in such a way that the cap is easily removable from the body to thereby facilitate replacement of the stream distributor and/or the nozzle, the latter being threaded into an interior bore of the sprinkler body. Nozzles threaded within the interior bores of sprinkler bodies, however, are difficult to access and usually involves removal of at least the cap/distributor assembly before access is gained to the nozzle. The nozzle must then be removed, usually with the help of a specialized tool.

The present invention relates to an improved modular sprinkler assembly which greatly facilitates the removal and replacement of the sprinkler nozzle. The invention also relates to a unique nozzle construction which allows the operator to easily identify the nozzle currently in use, and hence, also facilitates the selection of a replacement nozzle of the same or different size.

More specifically, the sprinkler body is provided with an inlet end having an internal screw thread which is adapted to receive a complementarily threaded male outlet end of the adapter. The adapter itself is provided with a second or inlet end for threaded connection to a drop tube, hose or other water supply conduit. An intermediate portion of the adapter between the threaded male inlet and outlet ends is provided with flat peripheral surfaces in the manner of a bolt head to facilitate loosening or tightening of the adapter with a wrench or similar tool.

The male outlet end of the adapter which is to be threadably secured within the sprinkler body inlet is in the form of four radially extending but circumferentially spaced lugs, each of which is provided with a part of the screw thread. This arrangement thus also provides an equal number of circumferentially spaced, axially extending recesses or grooves. In other words, this end of the adapter can be viewed as a conventional threaded male connector having an initially continuous screw thread which has been interrupted at circumferentially spaced locations by axially extending cut-out portions or grooves.

The unique nozzle construction in this exemplary embodiment includes a tubular portion having an inlet at one end and a discharge orifice at the opposite end. Adjacent the discharge orifice, there is provided an annular radially outwardly extending flanged portion. Four integral webs or struts spaced circumferentially about the flange, extend in an axial direction toward the inlet end of the tubular portion of the nozzle. The ends of the webs remote from the discharge orifice support an annular identification band concentrically with respect to the tubular portion and the discharge orifice. The identification band or ring has larger inside and outside diameters than the annular flanged portion, and is thus spaced radially outwardly of the tubular portion of the nozzle. As a result, the periphery of the identification band or ring extends radially beyond the adapter and is thus highly visible. The identification band or ring may be color coded to indicate nozzle size, or it may be embossed (or printed) with numbers or other indicia, also indicative of nozzle size.

The nozzle construction as described above is adapted to be telescoped over the outlet end of the adapter so that the tubular portion of the nozzle is received within the through bore of the adapter, with the webs or struts seated within the axial grooves between the threaded lugs. An O-ring, seated within an annular groove at the interface of the tubular portion and the annular flange of the nozzle, is designed to be compressed by the end face of the outlet end of the adapter, thus providing a water tight seal between the nozzle and the adapter. In other words, water flowing through the adapter must flow through the tubular portion of the nozzle and cannot escape in the area surrounding the webs or struts.

With the nozzle in place on the adapter, the adapter may be threadably secured within the inlet end of the sprinkler body. By seating the webs or struts in the axial grooves or recesses in the adapter, the webs do not interfere with the threaded connection between the adapter and the sprinkler body.

With the above described arrangement, it will be appreciated that the nozzle is easily changed simply by removing the adapter (no tools are required to remove the adapter), sliding the nozzle off the adapter, replacing it with a new nozzle, and rethreading the adapter into the sprinkler body. At the same time, the highly visible identification band on the nozzle allows the operator to quickly determine what size nozzle is currently in the sprinkler so that a replacement nozzle of the same size can be inserted, or where desired, so that a nozzle of a different size can be substituted for the original nozzle.

In its broader aspects, the invention relates to a sprinkler comprising an inlet and an outlet, an adapter secured to the inlet, and a rotatable stream distributor plate located downstream of the outlet, the improvement comprising a quick change nozzle slidably received on the adapter, the nozzle having a discharge orifice located at the outlet and an externally visible identification band adjacent the inlet at an interface between the adapter and the body.

In another aspect, the invention relates to a sprinkler comprising a body having an inlet end, an outlet end and a support structure extending beyond the outlet end; a tubular adapter removably secured to the inlet end of the body; a quick change nozzle slidably interposed between the adapter and the body such that part of the nozzle is received within the adapter and another part of the nozzle including a discharge orifice is received within the body and extends to the outlet end, and wherein the nozzle is held in place by the adapter; and a cap assembly removably secured to the support structure, the cap assembly mounting a rotatable stream distributor plate in axial alignment with the discharge orifice.

In still another aspect the invention relates to a sprinkler comprising a body having an inlet and an outlet, a first component adapted for connection to the inlet, the first component carrying a nozzle in at least partially telescoped relationship therewith, on one end of the first component; and wherein the one end is provided with a screw thread for threadably attaching the first component to the inlet.

In yet another aspect, the invention relates to a replaceable nozzle for use on a sprinkler, the nozzle comprising a radially inner tubular nozzle portion and a radially outer identification ring, the inner tubular nozzle portion and the outer identification ring being connected by a plurality of substantially axially extending struts.

It will be appreciated that the modular nozzle construction of this invention may be utilized in a number of different modular sprinkler constructions. Thus, various sprinklers for various specialized purposes are available, and the nozzle construction of this invention is easily adaptable to any number of sprinkler or other fluid flow devices. In addition, the cap assemblies of the sprinklers currently available from the assignee, Nelson Irrigation Corp., are themselves modular in nature in that they are easily assembled and disassembled from the sprinkler body, and also by reason of the fact that the cap assemblies are adapted to support different kinds of rotatable or fixed water distribution plates for different purposes.

It will therefore be appreciated that this invention provides a further degree of modularity to sprinkler constructions which greatly enhances the overall versatility and flexibility of such sprinklers, and which simplifies replacement/repair procedures in the field with no need for specialized tools, procedures, etc.

Other objects and advantages of the present invention will become apparent from the detailed description which follows.

BRIEF DESCRIPTION OF THE DRAWINGS

FIG. 4 is an end view of the adapter component which is incorporated within the sprinkler head shown in FIGS. 1 and 2;

FIG. 9 is a side elevation of an another modular sprinkler incorporating the modular nozzle of this invention; and FIG. 10 is a side elevation of a drag hose device incorporating the modular nozzle construction in accordance with this invention.

DETAILED DESCRIPTION OF THE DRAWINGS

Figure 1:
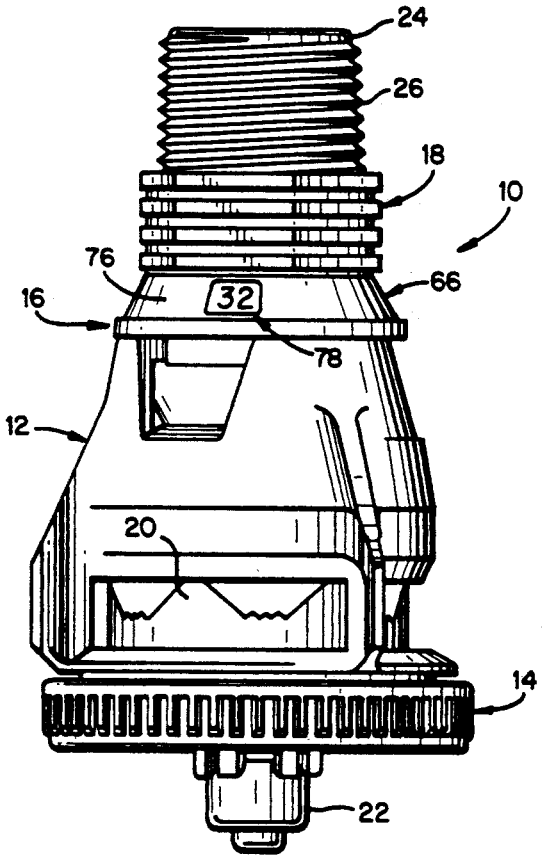
FIG. 1 is an elevation of a sprinkler head shown in an inverted orientation, adapted for connection to a drop tube of a pivot type irrigation apparatus, and incorporating the modular nozzle in accordance with the exemplary embodiment of this invention.

With reference to FIG. 1, the quick change, easily identifiable nozzle construction of this invention is incorporated into a modular rotator/spinner type sprinkler, generally indicated by reference numeral 10.

Figure 2:
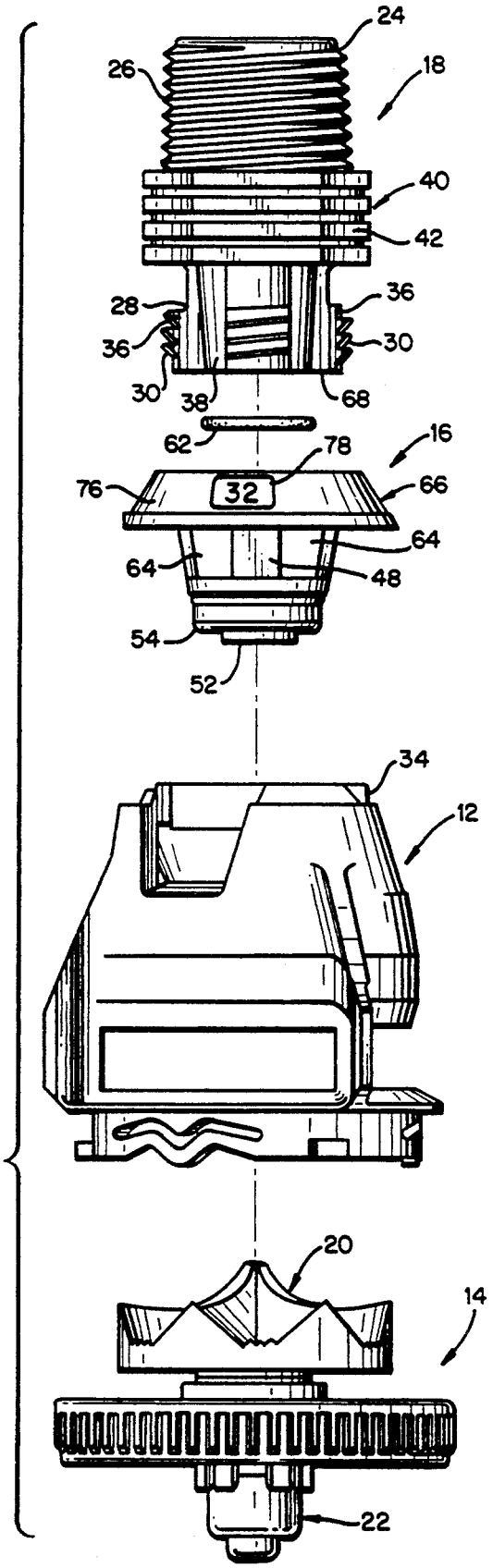
FIG. 2 is an exploded view of the sprinkler head shown in FIG. 1.

With reference also to FIG. 2, the sprinkler includes, generally, a body 12, a removable cap assembly 14, a nozzle 16 and an adapter 18. The cap assembly 14 includes a distribution plate or spinner 20 which redirects in a substantially radial direction a stream issuing from the nozzle 16 by reason of the multi-groove, multi-surface configuration of the spinner. The various grooves and surfaces are designed to cause the spinner and its associated shaft (not shown) to rotate in a known manner about a vertical axis extending through the center of the sprinkler. Rotation of the spinner is controlled by a viscous fluid brake or dampener (also known as a rotor motor) mechanism 22 which is frictionally held within a centrally oriented hub portion of the cap assembly. The spinner and associated brake mechanism are of conventional construction as reflected in current sprinklers available from Nelson Irrigation Corp. and do not per se constitute a part of this invention. Reference is also made in this regard to commonly owned U.S. Pat. Nos. Re. 33,823; 4,796,811 and U.S. Pat. Des. No. 312,865.

This invention relates specifically to the unique construction of the nozzle 16 and the manner in which it is received on the adapter 18 and held in place between the adapter 18 and the body 12.

Figure 6:
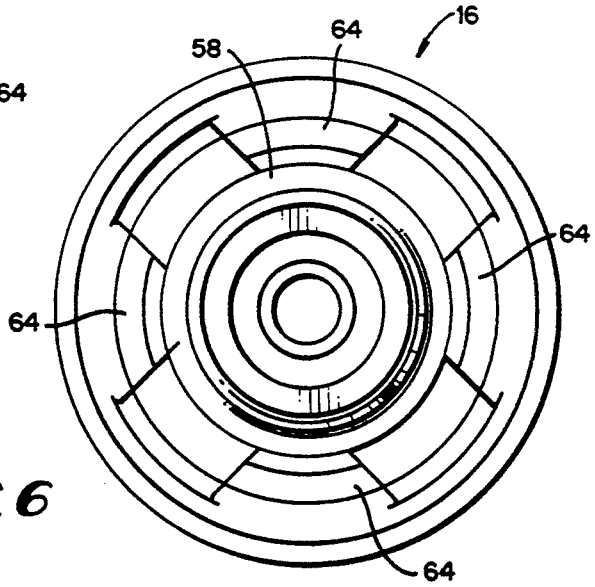
FIG. 6 is a bottom plan view of the nozzle illustrated in FIG. 1.

The adapter 18 includes a male inlet end 24 provided with an external screw thread 26 adapted for connection to a pivot drop tube, supply pipe, hose or the like. The adapter also includes a male outlet end 28 which is provided with an external discontinuous screw thread 30 adapted for threaded engagement with internal thread 32 (see FIG. 3) in the body inlet 34. The screw thread 30 is discontinuous in the sense that it is formed on four circumferentially spaced, axially extending lugs 36 (also see FIGS. 4 and 6), separated by four circumferentially spaced, axially extending recesses or grooves 38.

Figure 3:
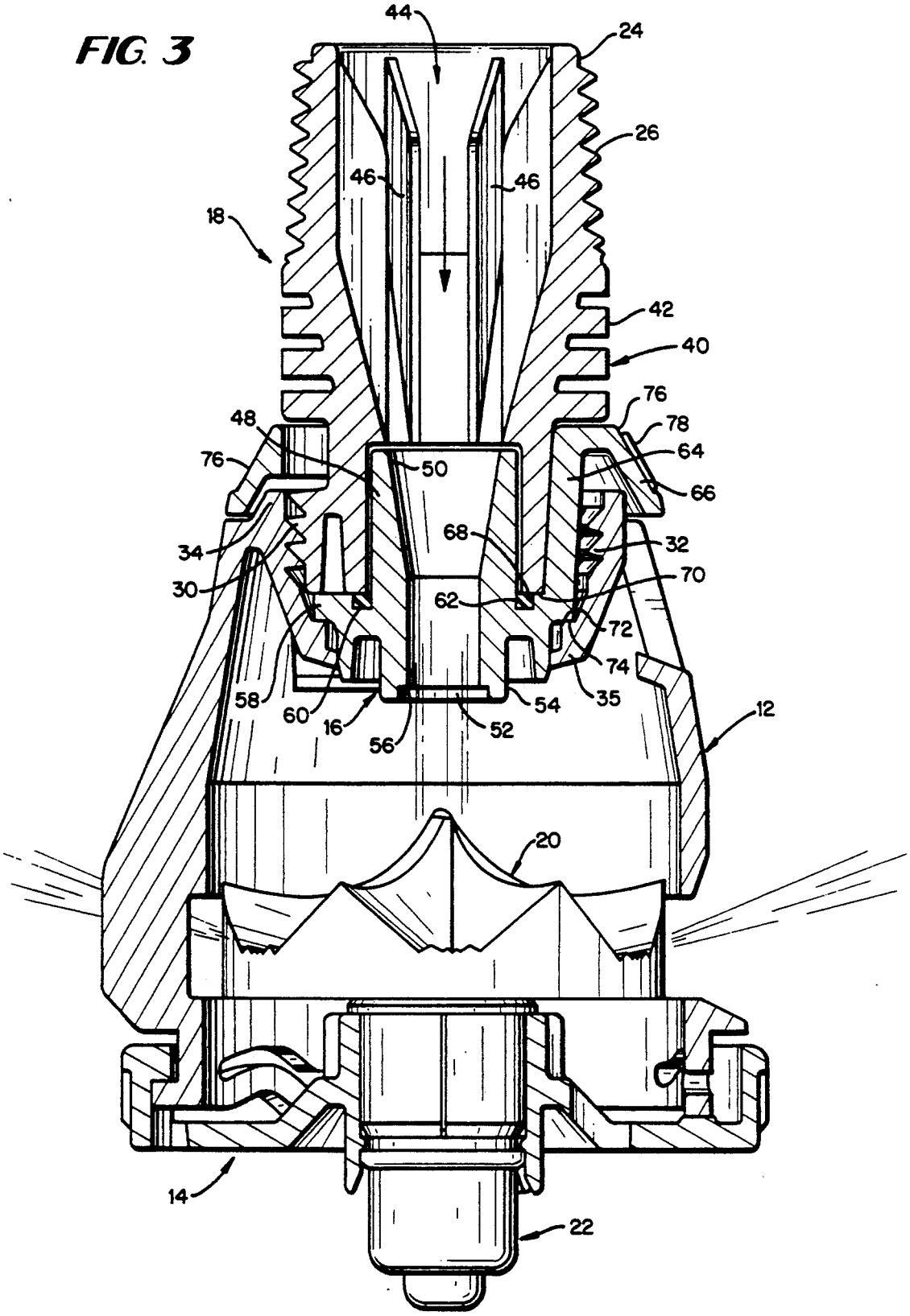
FIG. 3 is a side elevation similar to FIG. 1 but primarily in section.

An intermediate portion 40 of the adapter between the male inlet end 24 and male outlet end 28 is provided with six flat peripheral surfaces 42 (similar to a bolt head) which enable a wrench or similar tool to loosen or tighten the adapter as appropriate vis-a-vis a conduit or drop tube. The adapter 18 is also provided with a through bore 44 for supplying water under pressure to the sprinkler body 12, and the nozzle 16. As best seen in FIG. 3, the adapter through bore 44 tapers down to the inlet opening of the nozzle (described below); and includes flow straightening vanes 46.

With particular reference to FIGS. 2, 3, 5 and 6, the nozzle 16 includes a central, tubular portion 48 defining a flow passage having an inlet 50 at one end and a discharge orifice 52 at an opposite, outlet end 54. The nozzle flow passage tapers inwardly from the inlet end of the nozzle to a mid point of the flow passage, where the diameter remains constant until it reaches the discharge orifice 52 which is defined by a slightly enlarged radial shoulder 56. The outlet end 54 includes an annular flange 58 formed with an annular groove 60 for receiving an O-ring 62. At the radially outermost end of the flange 58, four webs or struts 64 are provided which are spaced radially outwardly of the tubular portion 48, and which extend substantially axially to the inlet 50 of the nozzle 16. These webs or struts 64 support an annular identification band or ring 66 which lies radially outwardly of the webs or struts 64, and which also lies radially outwardly of the adapter 18, so as to be easily visible.

Figure 8:
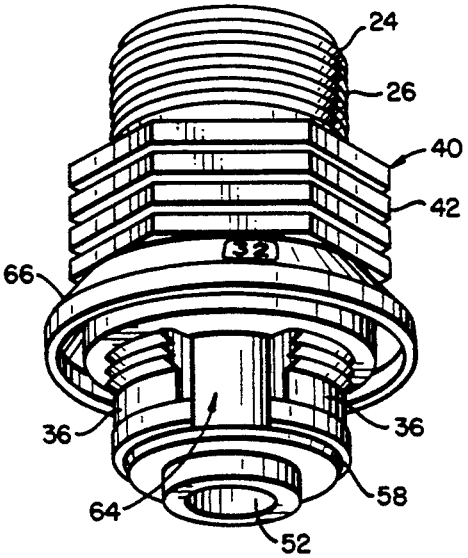
FIG. 8 is a perspective view of the nozzle in accordance with this invention mounted on one end of an adapter threadably receivable within the sprinkler body.
Figure 5:
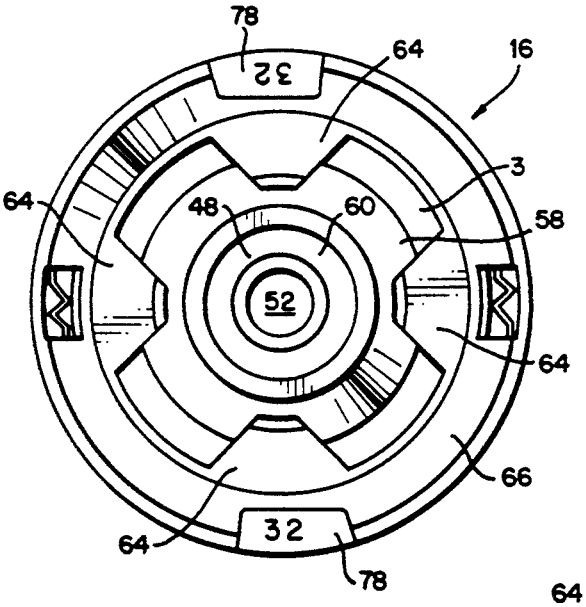
FIG. 5 is a top plan view of the nozzle illustrated in FIG. 1.

With specific reference to FIG. 8, it may be seen that the nozzle 16 may be telescoped over the male outlet end 28 of the adapter 18, such that webs or struts 64 are received or seated within the recesses or grooves 38, such that the adapter 18 is easily threaded into the inlet 34 of the body 12 without interference from the webs or struts 64. When fully inserted, the O-ring 62 in groove 60 will seat on the end face 68 of the adapter 18 and create a water tight seal therebetween. Further in this regard, one edge 70 of the flange also engages the end face 68 of the adapter while the opposite edge 72 engages an annular shoulder 74 on the body 12. Thus, the nozzle is securely sandwiched between the body 12 and adapter 18.

The identification band or ring 66 includes an inclined annular surface 76 which has integral embossments 78 thereon (or other indicia including nozzle size nos., color coding or the like) which otherwise serve to clearly identify the nozzle in use by orifice size. In the embodiment illustrated in FIGS. 1–3, the orientation of the sprinkler 10 is correct as shown, with the stream to be discharged vertically downwardly onto the spinner plate 20, as in the case where the sprinkler is supported on a pivot drop tube (not shown). Thus, the nozzle 16 is easily identifiable by mere inspection (without disassembly).

At the same time, the nozzle 16 is easily and quickly changed, simply by unscrewing the adapter 18, sliding the nozzle 16 off the adapter outlet end 28, replacing it with a new nozzle, and screwing the adapter 18 back into the body 12.

Figure 7:
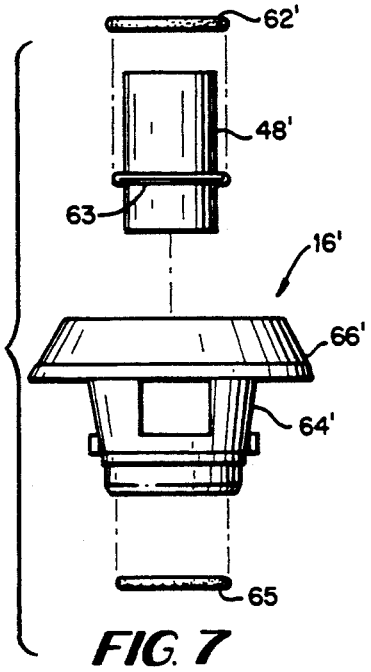
FIG. 7 is an exploded elevation of a nozzle in accordance with an alternative embodiment of the invention.

FIG. 7 illustrates a nozzle in accordance with an alternative embodiment of the invention. For convenience, reference numerals similar to those used in conjunction with the nozzle illustrated in FIGS. 1, 2, and 4 through 6, are used to designate corresponding components, but with a "prime" designation added. In this alternative embodiment, the tubular portion 48' of the nozzle 16' is in fact a discreet nozzle insert which may be constructed of brass or other suitable material. Also in this embodiment, the O-ring 62' will seat on an annular rib 63 forming a part of the nozzle, and a retaining ring 65 will be utilized to hold the nozzle 16' within the nozzle case.

Turning now to FIG. 9, a sprinkler 110 is illustrated which incorporates nozzle 116 in much the same manner as the sprinkler head illustrated in FIG. 1. In this embodiment, the sprinkler incorporates a cap assembly 114 mounting a spray head 120. The cap assembly 114 is of the flip over type, allowing a different type of spray head to be removably fixed to the opposite side of the cap as the spray head 120. In this way, the user can alter the sprinkling pattern simply by removing and inverting the cap assembly and reapplying it to the sprinkler.

With reference to FIG. 10, a hose drag adapter assembly 210 is illustrated incorporating a nozzle construction 216 in substantially the same manner as the embodiments illustrated in FIGS. 1 and 9.

From the above description, it will be appreciated that the subject invention provides further and beneficial flexibility and adaptability to modular sprinkler systems to a degree heretofore unknown in the sprinkler art.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a sprinkler comprising a body having an inlet and an outlet, an adapter having an end face secured to said inlet, and a rotatable stream distributor plate located downstream of said outlet, the improvement comprising a quick change nozzle slidably received on said adapter, said nozzle having a nozzle inlet at one end and a discharge orifice located at an opposite end adjacent said outlet; said nozzle also including an externally visible identification band adjacent said inlet at an interface between said adapter and said body, wherein said nozzle includes an annular, radial flange proximate to said opposite end, and further wherein an O-ring is compressed between said end face and said radial flange.

2. The sprinkler of claim 1 wherein said identification band is connected to said annular flange by a plurality circumferentially spaced, axially extending struts.

3. The sprinkler of claim 2 wherein said improvement also comprises said adapter being formed with a first threaded portion threadably received within the body inlet, said first threaded portion defined by a plurality of circumferentially spaced axially extending lugs, thereby defining a like plurality of circumferentially spaced, axially extending recesses, such that each of said plurality of struts is received in a respective one of said plurality of recesses.

4. The sprinkler of claim 1 wherein said identification band is provided with indicia indicative of nozzle size.

5. The sprinkler of claim 1 wherein said identification band is color coded in accordance with nozzle size.

6. A sprinkler comprising a body having an inlet end, an outlet end and a support structure extending beyond said outlet end; a tubular adapter removably secured to the inlet end of said body; a quick change nozzle slidably interposed between said adapter and said body such that part of said nozzle is received within said adapter and another part of said nozzle including a discharge orifice is received within said body, wherein said nozzle is held in place by said adapter; and further wherein said nozzle includes an integral, annular ring which is externally visible at an interface between said adapter and said body.

7. The sprinkler of claim 6 wherein said ring comprises an identification band which includes indicia indicative of nozzle size.

8. The sprinkler of claim 6 wherein said ring is color coded according to nozzle size.

9. The sprinkler of claim 6 wherein said rotatable stream distributor plate is secured to a rotatable output shaft of a viscous brake means for reducing the rotational speed of the distributor plate.

10. The sprinkler of claim 6 wherein said nozzle includes a tubular flow portion connected to said annular ring by a plurality of webs.

11. The sprinkler according to claim 6 and further comprising a cap assembly removably secured to said support structure, said cap assembly mounting a rotatable stream distributor plate in axial alignment with said discharge orifice.

12. A sprinkler comprising a body having an inlet and an outlet, a first component adapted for connection to said inlet, said first component carrying a nozzle in at least partially telescoped relationship therewith on one end of said first component; and wherein said one end is provided with a screw thread for threadably attaching said first component to said inlet, with said nozzle sandwiched therebetween; said nozzle including an externally visible identification band adjacent said inlet at an interface between said component and said body.

13. A replaceable nozzle for use on a sprinkler, the nozzle comprising a radially inner tubular nozzle portion and a radially outer identification ring, said inner tubular nozzle portion and said outer identification ring being connected by a plurality of substantially axially extending struts.

14. In a sprinkler comprising a body having an inlet and an outlet, an adapter secured to said inlet, and a rotatable stream distributor plate located downstream of said outlet, the improvement comprising a quick change nozzle slidably received on said adapter, said nozzle having a discharge orifice located at said outlet and an externally visible identification band adjacent said inlet at an interface between said adapter and said body; wherein said identification band comprises an annular ring concentric with said discharge orifice, and includes a surface tapered radially outwardly and downwardly in a direction toward the rotatable stream distributor plate.

15. The sprinkler of claim 14 wherein said surface includes indicia indicative of nozzle size.

16. In a sprinkler comprising a body having an inlet and an outlet, an adapter secured to said inlet, and a rotatable stream distributor plate located downstream of said outlet, the improvement comprising a quick change nozzle slidably received on said adapter, said nozzle comprising a radially inner tubular nozzle portion and a radially outer identification ring, said inner tubular nozzle portion and said outer identification ring being connected by a plurality of substantially axially extending struts.

17. The sprinkler according to claim 16 wherein said improvement also comprises said adapter being formed with a first threaded portion threadably received within the body inlet, said first threaded portion defined by a plurality of circumferentially spaced axially extending lugs, thereby defining a like plurality of circumferentially spaced, axially extending recesses, such that each of said plurality of substantially axially extending struts is received in a respective one of said plurality of recesses, and further wherein said nozzle is sandwiched between said body inlet and said adapter.

* * * * *